US008902108B2

(12) United States Patent
Spiess et al.

(10) Patent No.: US 8,902,108 B2
(45) Date of Patent: Dec. 2, 2014

(54) HOUSING ANTENNA SYSTEM

(75) Inventors: Oliver Spiess, Bocholt (DE); Klaus Tueshaus, Rhede (DE)

(73) Assignee: Gigaset Communications GmbH, München (DE)

( * ) Notice: Subject to any disclaimer, the term of this patent is extended or adjusted under 35 U.S.C. 154(b) by 475 days.

(21) Appl. No.: 12/809,448

(22) PCT Filed: May 30, 2008

(86) PCT No.: PCT/EP2008/004337

§ 371 (c)(1),
(2), (4) Date: Jul. 7, 2010

(87) PCT Pub. No.: WO2009/143863

PCT Pub. Date: Dec. 3, 2009

(65) Prior Publication Data

US 2011/0006955 A1 Jan. 13, 2011

(51) Int. Cl.
*H01Q 1/24* (2006.01)
*H01Q 1/50* (2006.01)

(52) U.S. Cl.
CPC ..... *H01Q 1/243* (2013.01)
USPC ..... 343/702; 343/906

(58) Field of Classification Search
USPC ..... 343/702, 872, 873, 906
See application file for complete search history.

(56) References Cited

U.S. PATENT DOCUMENTS

| | | | | |
|---|---|---|---|---|
| 4,814,776 | A | 3/1989 | Caci et al. | |
| 5,268,699 | A | 12/1993 | Laute et al. | |
| 7,671,804 | B2 * | 3/2010 | Zhang et al. | 343/700 MS |
| 2003/0045324 | A1 | 3/2003 | Nagumo et al. | |
| 2007/0241971 | A1 * | 10/2007 | Tsujimura et al. | 343/702 |
| 2008/0018541 | A1 * | 1/2008 | Pang et al. | 343/702 |
| 2008/0150811 | A1 * | 6/2008 | Honda et al. | 343/702 |
| 2009/0231215 | A1 * | 9/2009 | Taura | 343/702 |

FOREIGN PATENT DOCUMENTS

| | | | |
|---|---|---|---|
| CA | 2626589 | A1 | 5/2007 |
| EP | 0851531 | A2 | 7/1998 |
| EP | 1 329 980 | A1 | 7/2003 |
| EP | 1887650 | A | 2/2008 |
| EP | 1887650 | A1 | 2/2008 |
| WO | WO-2007/051295 | A1 | 5/2007 |

OTHER PUBLICATIONS

Translation of International Preliminary Report on Patentability for PCT/EP2008/004337 (Dec. 16, 2010).

* cited by examiner

*Primary Examiner* — Robert Karacsony
(74) *Attorney, Agent, or Firm* — Harness, Dickey & Pierce, P.L.C.

(57) ABSTRACT

A housing antenna system is proposed, by means of which automatic mass production of basic electrical or electronic devices having such a housing antenna system may be carried out in an economical and time-saving manner. This is achieved in that the housing antenna system is based on pressure contacting between the metallic antenna housing and the associated electronic circuit in order to operate the antenna housing as a housing antenna, using elastic elements.

1 Claim, 3 Drawing Sheets

HOUSING ANTENNA SYSTEM

CROSS-REFERENCE TO RELATED APPLICATIONS

This application is a National Stage of International Application No. PCT/EP2008/004337, filed on May 30, 2008. The entire disclosure of the above application is incorporated herein by reference.

BACKGROUND

This section provides background information related to the present disclosure which is not necessarily prior art.

1. Technical Field

The invention relates to a housing antenna system.

2. Discussion

To establish an electrical low-impedance connection between a metallic antenna housing and an electronic circuit which is provided for operating the antenna housing as a housing antenna and which is placed inside the antenna housing on an associated support which has connecting lines for sending and receiving electrical signals to and from the electronic circuit, wherein the connecting lines have contacting points for establishing an electrical connection between the electronic circuit and the metallic antenna housing, it is known to provide an assembly having screw fastenings as a corresponding connecting device.

Such an implementation has the disadvantage that automatic mass production of electrical or electronic devices by using such an assembly is very cost- and time-intensive.

SUMMARY OF THE INVENTION

An object of the present invention, therefore, starting with a housing antenna system of the aforementioned type, is to technically improve same in such a way that automatic mass production of electrical or electronic devices may be carried out in an economical and time-saving manner.

Accordingly, a housing antenna system is proposed whose implementation is based on pressure contacting between the metallic antenna housing and the associated electronic circuit in order to operate the antenna housing as a housing antenna, using elastic elements.

The housing antenna system according to the preferred embodiment of the invention allows automatic mass production of electrical or electronic devices in an economical and time-saving manner by using such a housing antenna system.

The housing antenna system according to the preferred embodiment of the invention also allows nondestructive disassembly of affected devices, since there is no joint connection such as direct soldering or gluing, for example.

Another advantage is that the housing antenna system according to the preferred embodiment of the invention may be used for affected devices in which no visible screw fastenings are permitted for design reasons.

Accordingly, there is a selection option between an implementation in which the elastic elements are fixedly connected to the metallic antenna housing, and the contacting points of the connecting lines of the electronic circuit on the support are elastically contacted, and an implementation in which the elastic elements are fixedly mounted on the contacting points of the connecting lines of the electronic circuit situated on the support, and the metallic antenna housing is elastically contacted.

The elastic elements may be fixed to either the metallic antenna housing or on said support by soldering, for example.

If the elastic elements are fixed on said support, in one particularly advantageous embodiment of the invention, at locations at which the elastic elements elastically contact the antenna housing the metallic antenna housing is provided with independent contact elements which have particularly good electrical conductivity.

A particularly good electrically conductive connection between the antenna housing and said electronic circuit is important for a housing antenna which functions particularly well.

In another advantageous embodiment of the invention, the elastic contact elements are designed as SMD contact springs. Such contact springs are economical and allow a compact design of affected devices.

In another advantageous embodiment of the invention, the distance of the electrical connection between locations where contact is made with the metallic antenna housing and the electronic circuit is selected to be as short as possible. The introduction of undesired inductance is thus avoided.

BRIEF DESCRIPTION OF THE DRAWINGS

The drawings described herein are for illustrative purposes only of selected embodiments and not all possible implementations, and are not intended to limit the scope of the present disclosure.

Exemplary embodiments of the invention are explained in greater detail below with reference to the figures, which show the following.

Identical parts are provided with the same reference numerals in the figures.

DETAILED DESCRIPTION OF THE PREFERRED EMBODIMENTS

Example embodiments will now be described more fully with reference to the accompanying drawings.

Figure 1:
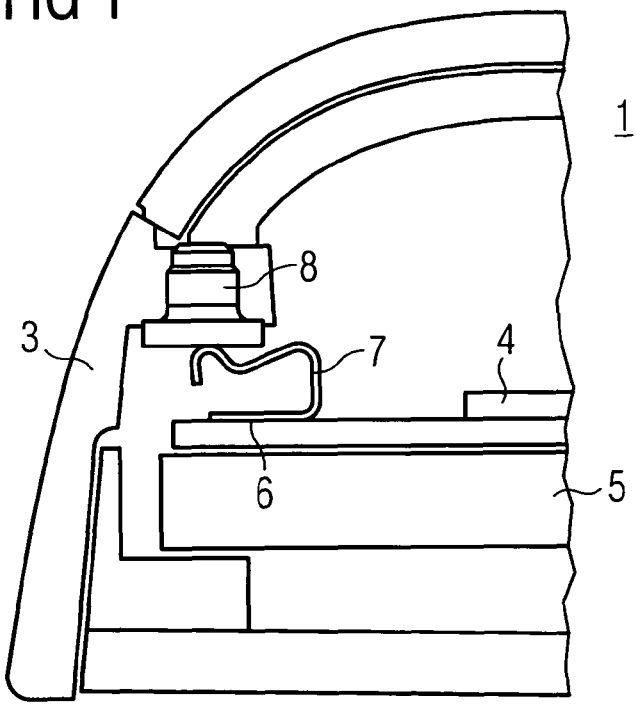
FIG. 1 shows a first exemplary embodiment of the invention.
Figure 2:
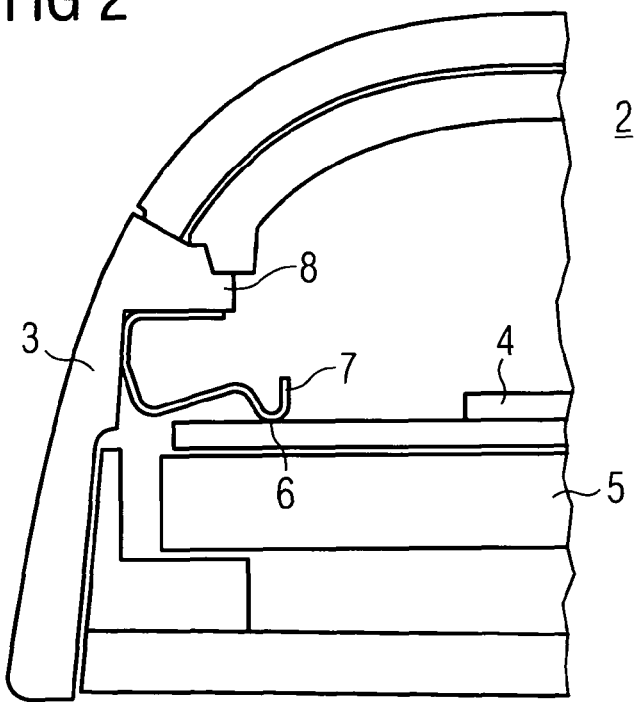
FIG. 2 shows a second exemplary embodiment of the invention.
Figure 3:
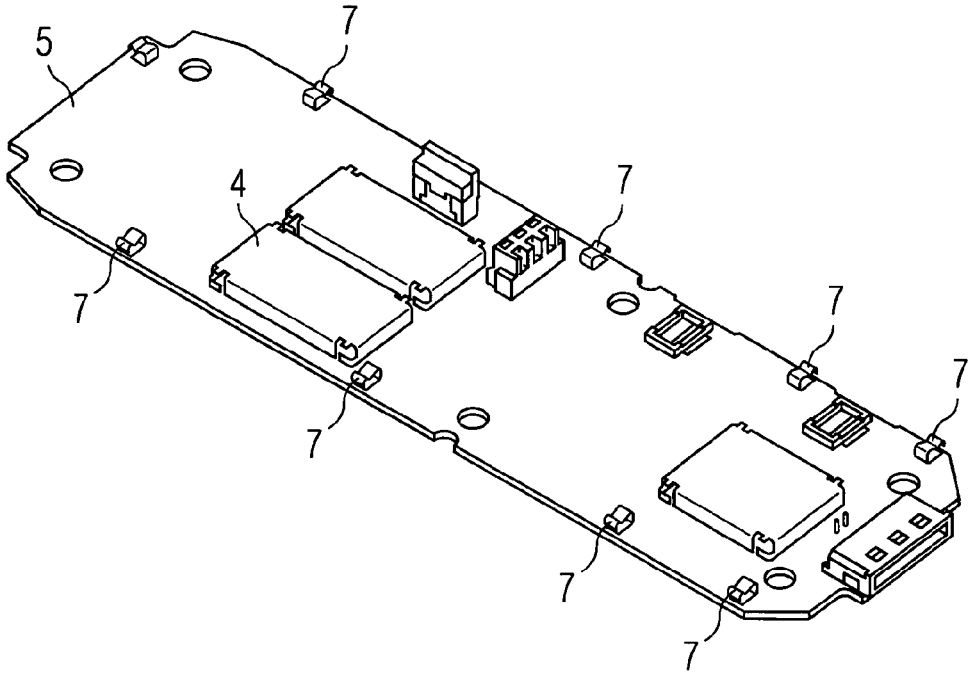
FIG. 3 shows an electrical assembly according to the invention for the exemplary embodiment in FIG. 1.
Figure 4:
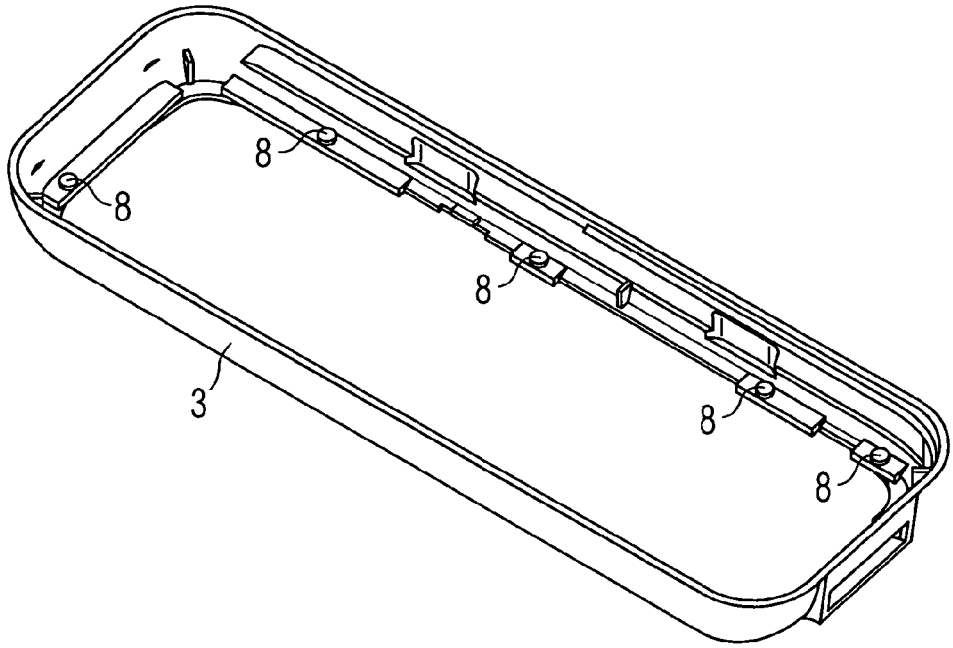
FIG. 4 shows an antenna housing according to the invention for the exemplary embodiment in FIG. 1.
Figure 5:
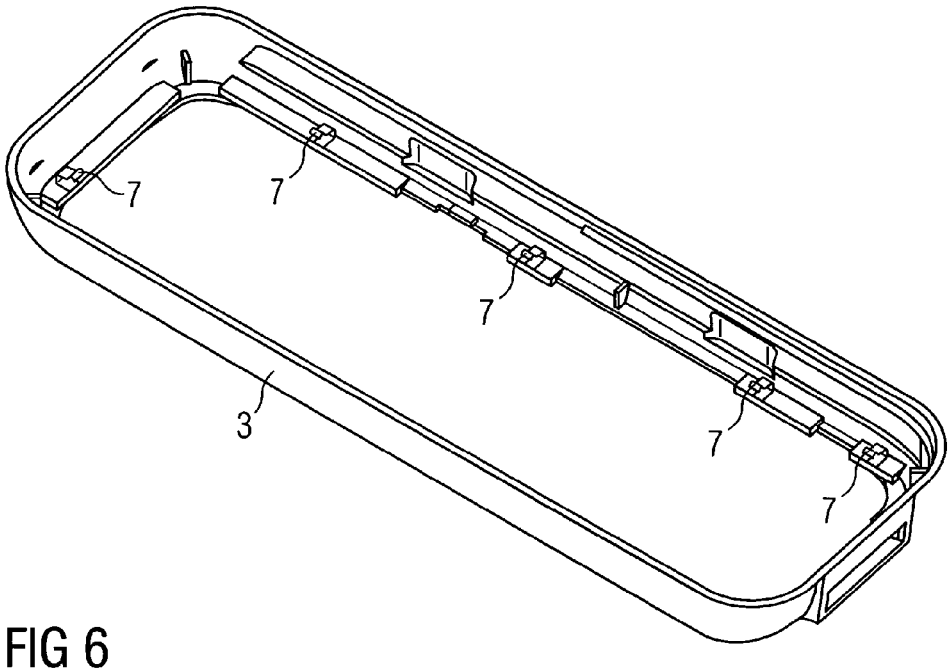
FIG. 5 shows an antenna housing according to the invention for the exemplary embodiment in FIG. 2.
Figure 6:
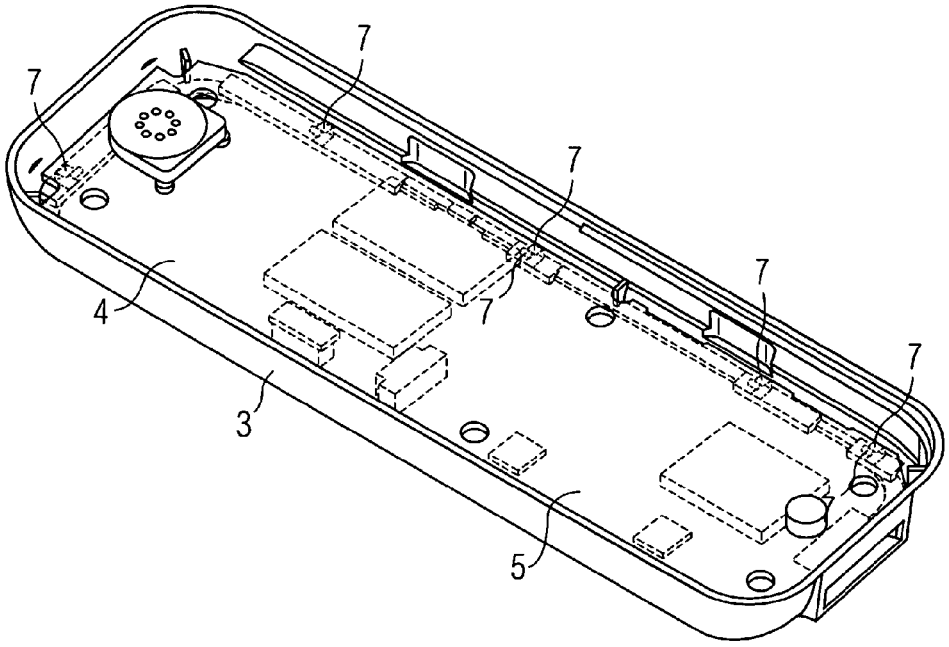
FIG. 6 shows an electrical assembly and an antenna housing according to the invention for the exemplary embodiment in FIG. 2, the electrical assembly being mounted in the antenna housing.

FIG. 1 shows a first housing antenna system 1, and FIG. 2 shows a second housing antenna system 2.

Both housing antenna systems 1 and 2 have a metallic antenna housing 3, and an electronic circuit 4 for operating the antenna housing 3 as a housing antenna.

The electronic circuit 4 is mounted on a support 5.

The support 5 in the detail is a printed circuit board.

The electronic circuit 4 and the support 5, i.e., the printed circuit board, together form an electrical assembly. As an electrical assembly, further electric circuits are mounted on the support 5 which, however, do not play a role in the present context, and for simplicity are omitted in the present exemplary embodiments and also are not further mentioned.

The electrical assembly and thus also the electronic circuit 4 in particular are placed inside the antenna housing 3.

The support 5 has connecting lines for sending and receiving electrical signals to and from the electronic circuit 4; the connecting lines likewise are not illustrated in further detail in the figures.

The connecting lines also have contacting points 6 for establishing an electrical connection between the electronic circuit 4 and the metallic antenna housing 3.

The housing antenna systems according to FIGS. 1 and 2 also have a connecting device for establishing the electrical connection between the metallic antenna housing 3 and the electronic circuit 4.

Reference to establishing a connection to the electronic circuit 4 is also understood to mean that a connection is established via the previously mentioned contacting points 6 and the connecting lines which are connected thereto.

According to the present exemplary embodiments in FIGS. 1 and 2, said connecting device for establishing the electrical connection between the metallic antenna housing 3 and the electronic circuit 4 on the support 5 has elastic elements 7 distributed along the periphery of the metallic antenna housing 3.

According to the embodiment in FIG. 1, the elastic elements 7 are fixedly mounted on the contacting points 6 of the connecting lines of the electronic circuit 4 which are situated on the support 5. In this type of installation, the elastic elements 7 elastically contact the metallic antenna housing 3.

According to the embodiment in FIG. 2, the elastic elements 7 are fixedly connected to the metallic antenna housing 3. In this type of installation, the elastic elements 7 elastically contact the contacting points 6 of the connecting lines of the electronic circuit 4 on the support 5. At locations at which the elastic elements 7 elastically contact the antenna housing 3, the metallic antenna housing 3 has independent contact elements 8 which have particularly good electrical conductivity and which are fixedly connected to the metallic antenna housing 3.

According to the present exemplary embodiments, the elastic contact elements 7 are designed as SMD contact springs.

In addition, according to the present exemplary embodiments the respective applicable distances between the particular locations at which contact is made with the metallic antenna housing 3 and the electronic circuit 4, viewed from the particular affected site, are selected to be short; i.e., the line routing of the particular affected connecting line is selected to be as straight as possible.

In FIGS. 3 through 6, the elements discussed in conjunction with FIGS. 1 and 2 and provided with reference numerals are seen from another perspective, at least in part. In particular with regard to FIG. 6, it is noted that the independent contact elements 8 which are present in the antenna housing 3 and which are used to elastically contact the concealed elastic elements 7, starting from the support 5, are not explicitly indicated. Therefore, the elastic elements 7 are shown as concealed in FIG. 6 because the support 5 is mounted top side down in the antenna housing 3.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. An antenna system comprising:

an antenna housing having an upright side wall with an inwardly extending ledge, the housing having an inner surface and an outer surface, the housing being fully metallic in at least one area from the inner surface to an outer surface thereof and being configured as an antenna;

a printed circuit board supported on the inner surface of the housing;

an electronic circuit on the printed circuit board;

connecting lines on the printed circuit board running from the electronic circuit to underneath the ledge of the housing; and a plurality of electrically conductive spring members, each of said spring members having one end contacting one of said connecting lines and another end contacting the ledge of the housing;

wherein the printed circuit board can be disassembled from the housing.

* * * * *